US007076985B2

(12) United States Patent
Rex

(10) Patent No.: US 7,076,985 B2
(45) Date of Patent: Jul. 18, 2006

(54) WIRE WINDING MACHINE

(76) Inventor: Howard Thomas Rex, 3439 White Eagle Dr., Naperville, IL (US) 60564

( * ) Notice: Subject to any disclaimer, the term of this patent is extended or adjusted under 35 U.S.C. 154(b) by 0 days.

(21) Appl. No.: 10/792,594

(22) Filed: Mar. 3, 2004

(65) Prior Publication Data

US 2005/0193794 A1 Sep. 8, 2005

(51) Int. Cl.
*B21C 1/02* (2006.01)

(52) U.S. Cl. ..... 72/289

(58) Field of Classification Search ..... 72/289, 72/287, 280, 183, 278
See application file for complete search history.

(56) References Cited

U.S. PATENT DOCUMENTS

| | | | | |
|---|---|---|---|---|
| 452,837 | A | 5/1891 | Ellis | |
| 489,588 | A | 1/1893 | Lamb | |
| 1,637,700 | A * | 8/1927 | Lee et al. | 242/364 |
| 1,720,676 | A * | 7/1929 | Hosford | 72/289 |
| 2,508,977 | A * | 5/1950 | Todd | 72/163 |
| 2,921,671 | A | 1/1960 | McMartin | |
| 3,017,017 | A * | 1/1962 | Bruestle | 72/419 |
| 3,079,976 | A * | 3/1963 | Ranney | 72/164 |
| 4,050,641 | A * | 9/1977 | Henrich | 242/478.2 |
| 6,352,215 | B1 * | 3/2002 | Cash et al. | 242/574.2 |
| 6,691,544 | B1 * | 2/2004 | Steudle et al. | 72/164 |

* cited by examiner

*Primary Examiner*—Daniel C. Crane
(74) *Attorney, Agent, or Firm*—Carlson, Gaskey & Olds

(57) ABSTRACT

A wire winding machine has a winding wheel that includes a central core having an adjustable outside dimension. A central member and a plurality of outer members are connected with linkages that allow the outside dimension to be adjusted. At least one of the outer members is moveable once a desired amount of wire has been wound so that the wound wire can be removed in an axial direction relative to the winding wheel. In a disclosed example, an end member of the winding wheel cooperates with at least the one outer member to move it into a first position for receiving the wire and releasing it to be moveable a second position for removing the wound wire from the central core of the winding wheel.

16 Claims, 6 Drawing Sheets

WIRE WINDING MACHINE

BACKGROUND OF THE INVENTION

This invention generally relates to wire winding devices. More particularly, this invention relates to a wire winding machine having a unique arrangement for removing wound wire from the machine.

Wire winding processes are well known. Wire stock is pulled through a die to a desired dimension and then wound onto a spool for storage, shipping, etc. Conventional arrangements had one machine for drawing the wire stock through the die and a completely separate machine for winding the wire into a coil. There is a need for a more efficient arrangement.

Another drawback associated with conventional arrangements is handling the wound wire. Conventional arrangements do not provide efficient mechanisms for removing the wound wire from the machine for subsequent handling. There is a need for an improved arrangement in this regard.

This invention addresses those needs while avoiding the shortcomings and drawbacks of previous arrangements.

SUMMARY OF THE INVENTION

In general terms, this invention is a wire winding device that facilitates more efficient handling of wound wire.

One example winding device is a winding wheel that includes a central member and a plurality of outer members. The outer members define an outside dimension of the device such as a circumference of a wire supporting central core of the winding wheel. An end member is moveable relative to the central member between a first position where the end member is axially spaced from the outer members and a second position where the end member engages at least one of the outer members to adjust the outside dimension.

In one example, the end member includes a locator and at least one of the outer members has a cooperating receiver that the locator engages such that axial movement of the end member moves at least the one outer member. As the outer member moves, the outside dimension changes.

In one example, there are a plurality of outer members that are each pivotally supported for movement relative to arms on the central member for adjusting the outside dimension. In one example, a plurality of link members are associated with the outer members and the arms. The link members are disposed at an oblique angle relative to an axis of the central member when the outer members are in a position corresponding to a largest outside dimension.

A machine designed according to this invention includes a die sized to form a wire of a desired diameter. A drawing wheel pulls wire stock through the die. The drawing wheel maintains the wire under tension between the die and the drawing wheel. A winding guide receives wire exiting the drawing wheel and has a guiding element that moves axially relative to an axis of the drawing wheel. A winding wheel receives wire from the winding guide and has a core with an adjustable outside dimension for winding a selected amount of wire around the core and then releasing the wound wire from the core. A coil mover is moveable relative to the winding wheel into a position beneath the wound wire to support the wound wire for horizontal, axial movement relative to the winding wheel when the wound wire is released from the core.

In one example, the coil mover includes a moveable support that is moveable in a direction perpendicular to the axis of the winding wheel such that the support is selectively moved into a position to contact the wound wire. Another example includes a track that guides the coil mover when it moves relative to the winding wheel.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
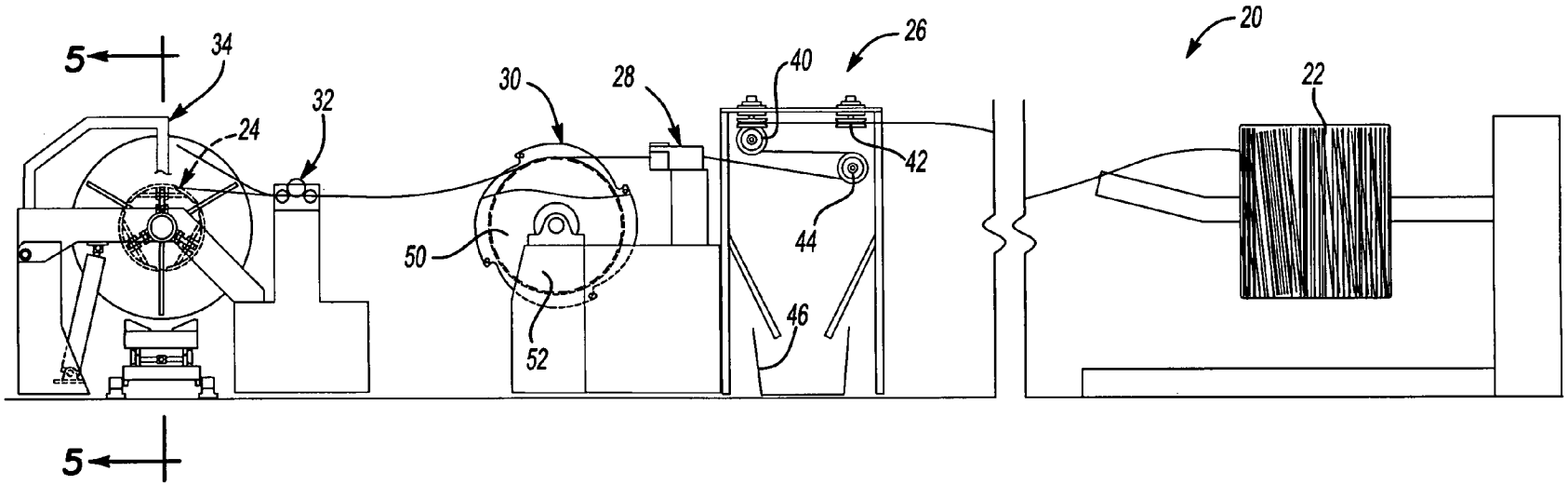
FIG. 1 schematically illustrates a wire winding machine designed according to an embodiment of this invention.

FIG. 1 schematically illustrates a wire winding and drawing machine 20 where a stock of wire 22 is eventually wound into a bundle or coil 24. A scale removing station 26 receives the wire stock 22 before it is pulled through a die 28 by a drawing station 30. A winding guide 32 guides the formed wire onto a winding station 34 from which the wound wire is eventually removed from the machine.

The scaling station 26 includes a plurality of rollers 40, 42 and 44, for example, about which the wire stock 22 is wound to remove scale or other debris from an exterior of the stock 22 in a known manner. A scale collecting bin 46 receives that which is removed from the stock 22 by operation of the rollers 40, 42 and 44.

A drawing wheel 30 pulls the wire stock under tension through a conventional die 28. The die 28 has an opening sized to make the wire of the desired gage, for example. In one example, the wire is eventually used for concrete reinforcement rod. A variety of sizes of wire and types of material for making the wire can be used.

In the example arrangement, the drawing station 30 includes a drawing wheel 50 and a motorized mechanism 52 for rotating the drawing wheel. The wire stock 22 pulled through the die 28 is maintained under tension between the drawing wheel 50 and the die 28. In one example, at least two wrappings 54 and 56 wrap around the drawing wheel 50 before the wire is paid out to the winding guide 32. Applying sufficient tension to draw the wire through the die 28 using a drawing wheel 50 that is separate from the winding station 34 allows the machine to operate in an efficient and reliable manner. Arrangements that rely upon the winding station 34 to exert the forces necessary to draw the wire stock 22 through the die 28 can tend to bind up and have other problems that interrupt the manufacturing process. Machine down time is a significant cost factor that preferably is avoided. The example arrangement utilizes the separate drawing wheel 50 to apply pressure as needed to draw the wire stock through the die 28 and allows for less tension between the drawing wheel 50 and the winding station 34.

The example winding guide 32 includes a moving member 60 through which the formed wire is fed. A threaded member 62 provides a surface along which the guide member 60 moves back and forth as indicated by the arrow 64. A motorized moving mechanism 66 rotates the threaded member 62 as required to cause the guide member 60 to move back and forth. A frame 68 supports the operative components of the winding guide 32.

The winding station 34 in this example includes a frame 70 that supports a winding wheel 72 so that the wheel 72 can rotate and wind the wire 24 into a bundle or coil configuration. The winding guide 32 facilitates the appropriate coil formation.

In the illustrated example, the frame 70 includes a stationary portion 74 and a moveable portion 76. In this example, a cage portion 78 is supported for movement with the moveable portion 76. As best appreciated from FIGS. 2 and 3, one surface 80 on the moveable portion 76 cooperates with the frame 68 of the winding guide 32 to position the moveable frame portion 76, cage portion 78 and other components (to be described below) in an appropriate position for the winding wheel 72 to operate as desired. In the illustrated example, a pressurized actuator 82 facilitates moving the moveable frame portion 76 between positions illustrated in FIGS. 2 and 3. In one example, the pressurized actuator 82 is pneumatic. In another example, it is hydraulic.

Figure 2:
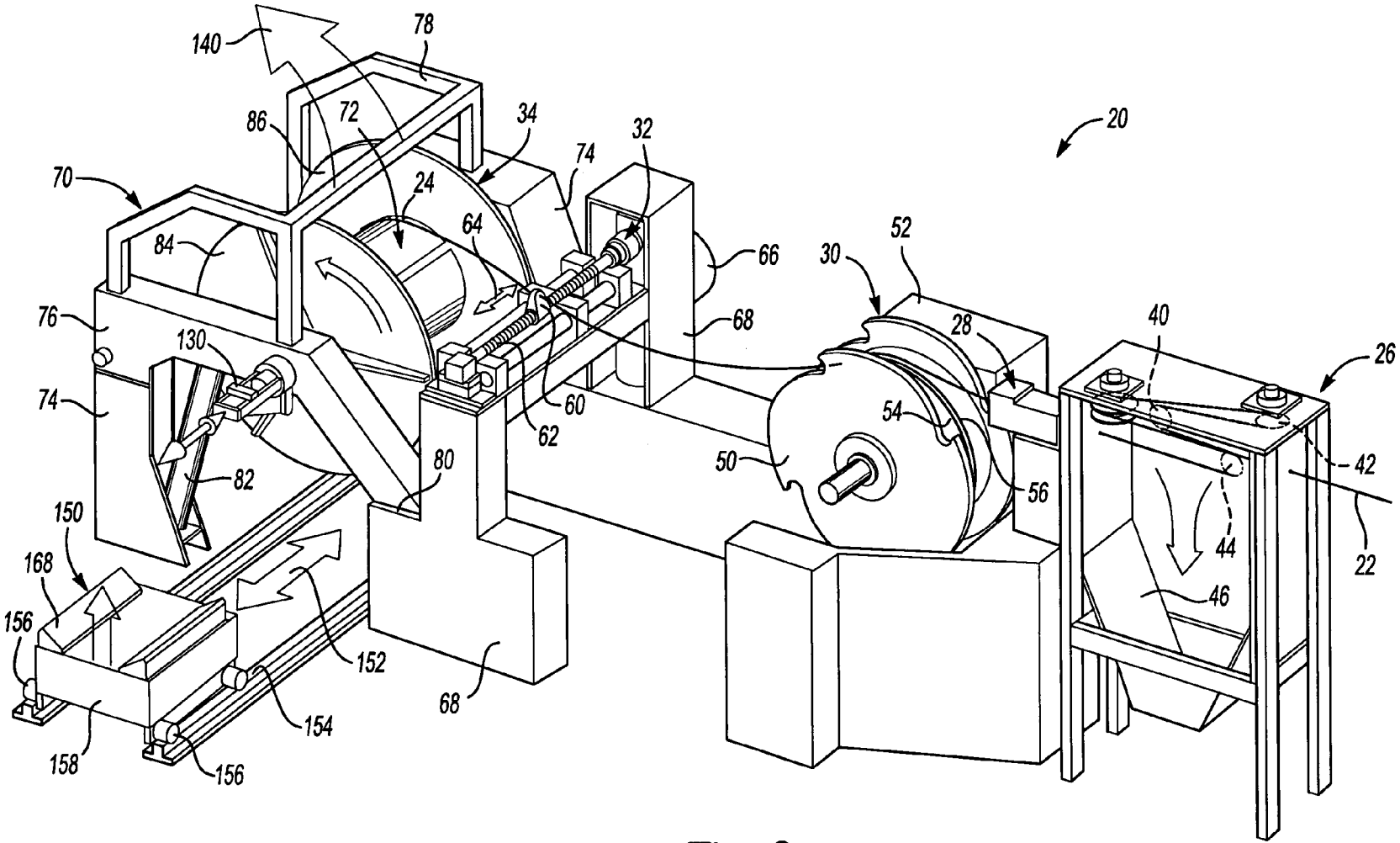
FIG. 2 is a perspective illustration of selected portions of the embodiment of FIG. 1.
Figure 3:
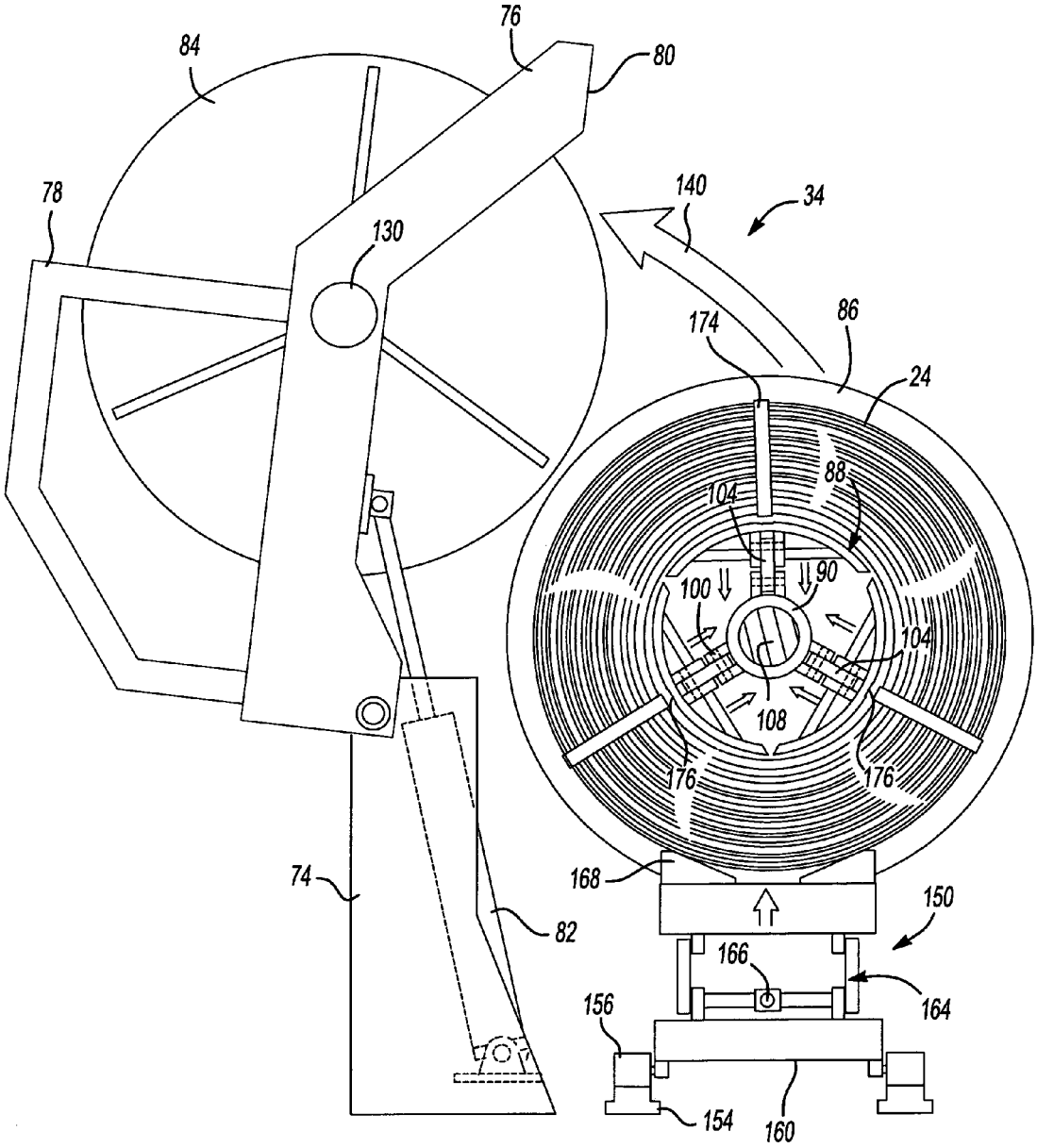
FIG. 3 is a side view of selected components of the embodiment of FIG. 2.

In FIG. 2, a first end member 84 of the winding wheel 72 is axially aligned with a second end member 86 and a central core 88. In the example of FIG. 3, the moveable frame portion 76 and the first end member 84 are in a position where they are radially clear of the central core 88 and the wound wire 24. Moving those components into the position of FIG. 3 facilitates sliding the wound wire 24 horizontally (according to the drawings) in an axial direction off of the central core 88 once a desired amount of wire has been wound.

Figure 4:
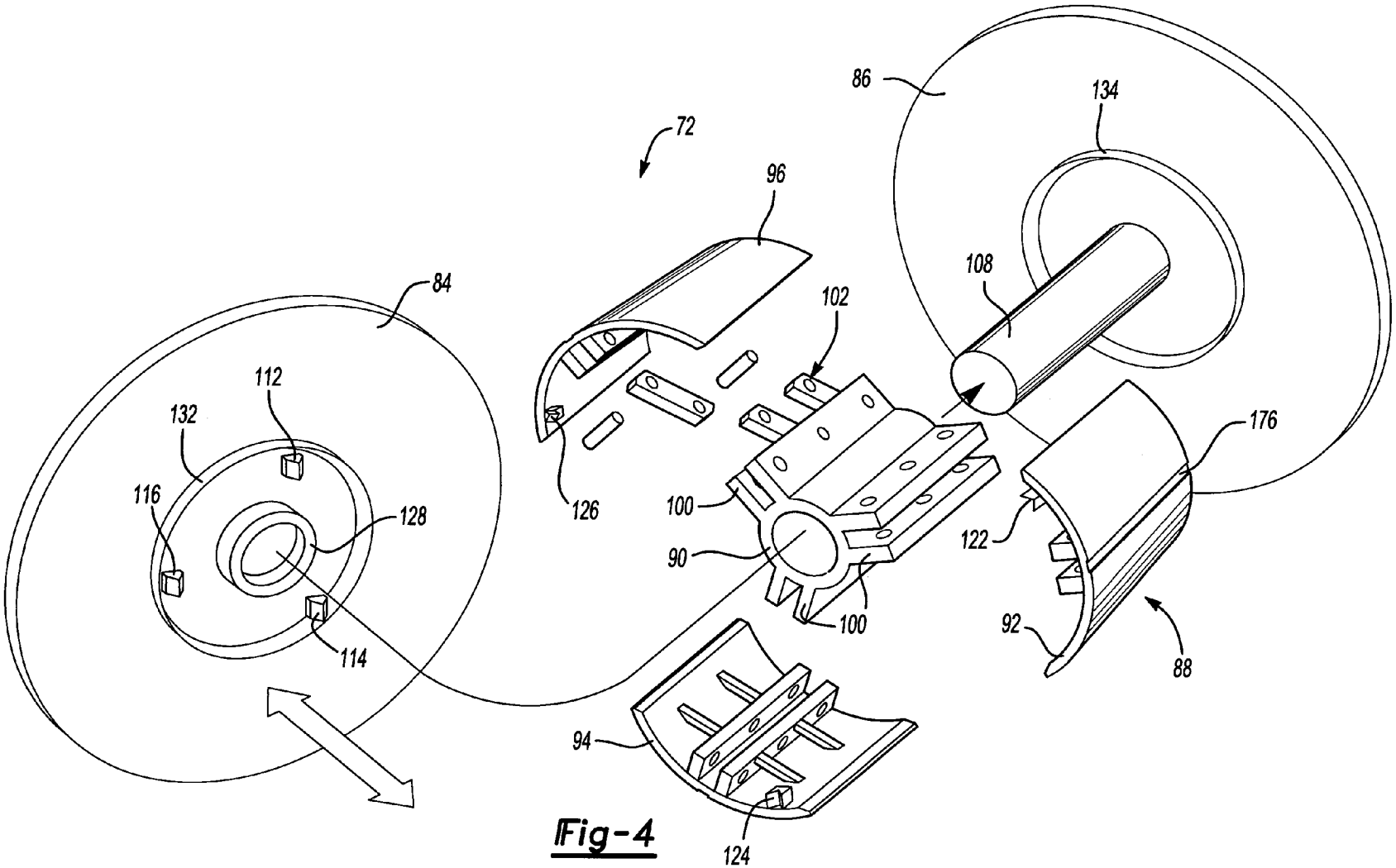
FIG. 4 is a partially exploded view of an example winding wheel designed according to an embodiment of this invention.

Referring to FIGS. 3 and 4, the example winding wheel 72 has a central core 88 that comprises a central member 90 and a plurality of outer members 92, 94 and 96. The central member 90 includes a plurality of arms 100 that support linkages 102 that are associated with the outer members. In the illustrated example, there are three outer members 92, 94, 96 and three sets of arms 100. Each of the outer members 92, 94, 96 in the illustrated example is moveable relative to the central member 90 so that an outside dimension (i.e., circumference) of the central core 88 is adjustable. As can be appreciated from FIGS. 3–6, the outer members are supported by link members 104 that are positioned at the oblique angle relative to an axis 106 of a shaft 108 of the core 88 when the outer members establish a largest outside dimension of the core 88.

In this example, the central member 90 is received over the shaft 108 and rotatable relative to the shaft. When the outer members 92, 94 and 96 are trapped between the end members 86 and 84, which in this example comprise disks, the shaft 108, central member 90, outer members 92, 94, 96 and end members 84, 86 rotate in unison. The illustrated example includes a motor 110 that rotates the winding wheel 72 for receiving the wire 24 until a desired amount is wound.

Figure 5:
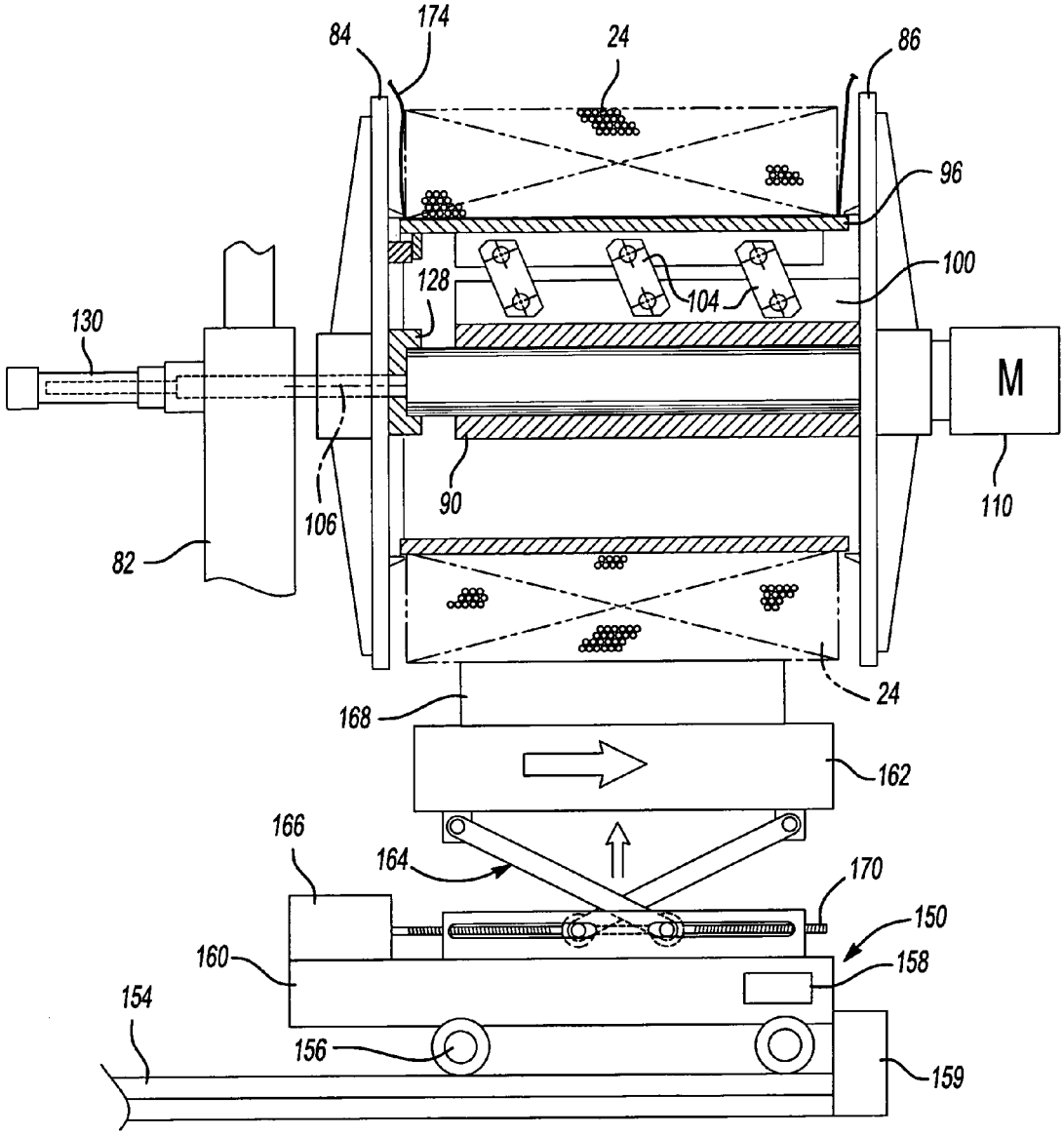
FIG. 5 is a view taken along the lines 5—5 in FIG. 1.
Figure 6:
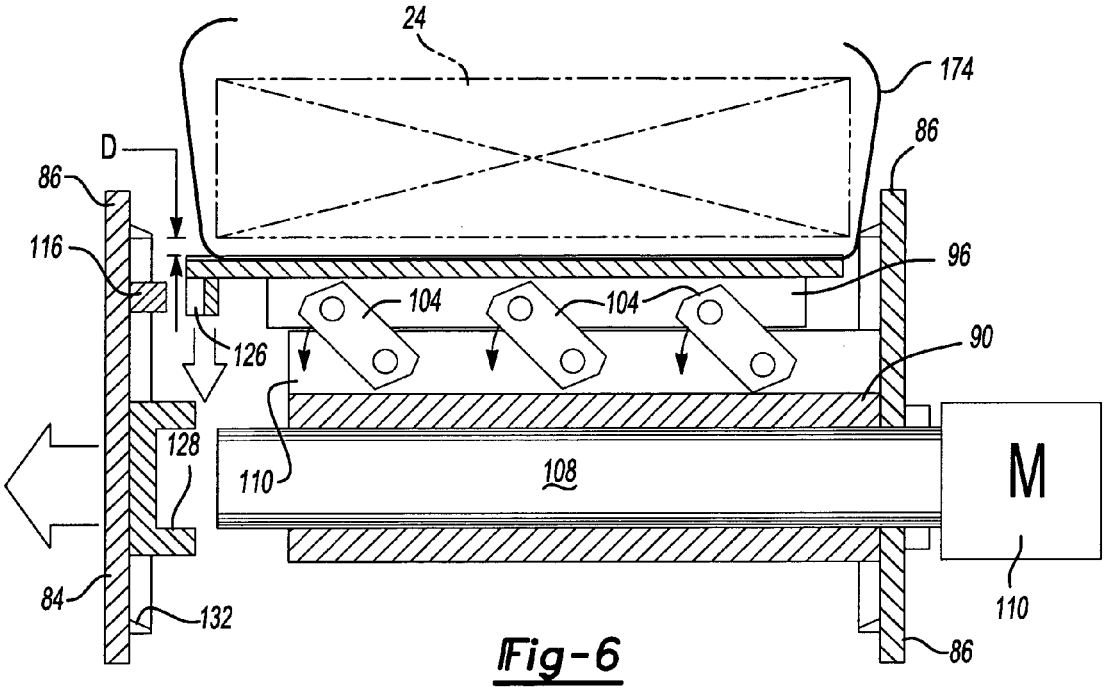
FIG. 6 is a partial cross-sectional view showing the winding wheel embodiment of FIGS. 3–5 at one stage of machine operation.

When the end member 84 is axially aligned with the shaft 108, central member 90, and the end member 86, it is moveable in an axial direction between a first position where the end member 84 is spaced from the outer members 92, 94 and 96. This position is shown, for example, in FIG. 6. An automated moving mechanism 130 moves the end member 84 in an axial direction toward the end member 86 until a centering boss 128 is received over the end of the shaft 108 (FIG. 5). As shown in FIG. 5, for example, the end member 84 includes a plurality of locators 112, 114 and 116. Each locator is received by a corresponding receiver 122, 124 and 126 on a corresponding one of the outer members 92, 94 and 96. The cooperation between the locators and the receivers insures that the outer members and the end member 84 rotate in unison. Moreover, this cooperation provides for adjusting the outside dimension of the central core 88. When the locators 112, 114, 116 engage the corresponding receivers 122, 124, 126, axial movement of the end member 84 causes movement of the outer members 92, 94, 96 relative to the central member 90. As can be appreciated from the drawings, in the illustrated example, the links 104 of the linkage assemblies 102 pivot from the position shown in FIG. 6 to the position shown in FIG. 5 as the end member 84 moves axially toward the end member 86. Eventually, the outer members 92, 94 and 96 are received against the inside edge of a flange 132 on the end member 184 and a flange 134 on the end member 86. The size of the outer members 92, 94, 96 and their position relative to the shaft 108 defines the outside dimension of the wire receiving portion of the winding wheel 72. At this point, the winding wheel 72 is set having a largest operating outside dimension for receiving the wire 24 to be wound.

The example embodiment has a unique arrangement for removing the wound wire 24 from the winding wheel 72. Once an appropriate amount of wire has been wound, the mover 130 causes the end member 84 to move axially away from the end member 86 as shown by the arrow in FIG. 6. Upon sufficient movement away from the outer members 92, 94 and 96, the end member locators 112, 114 and 116 separate from the locators 122, 124 and 126, which allows for the outside dimension of the central core 88 to be adjusted to a smaller dimension. In the illustrated example, at least one of the outer members (96 in this example) is associated with links 104 that are in a plane that is generally perpendicular aligned relative to a floor or base surface.

Figure 7:
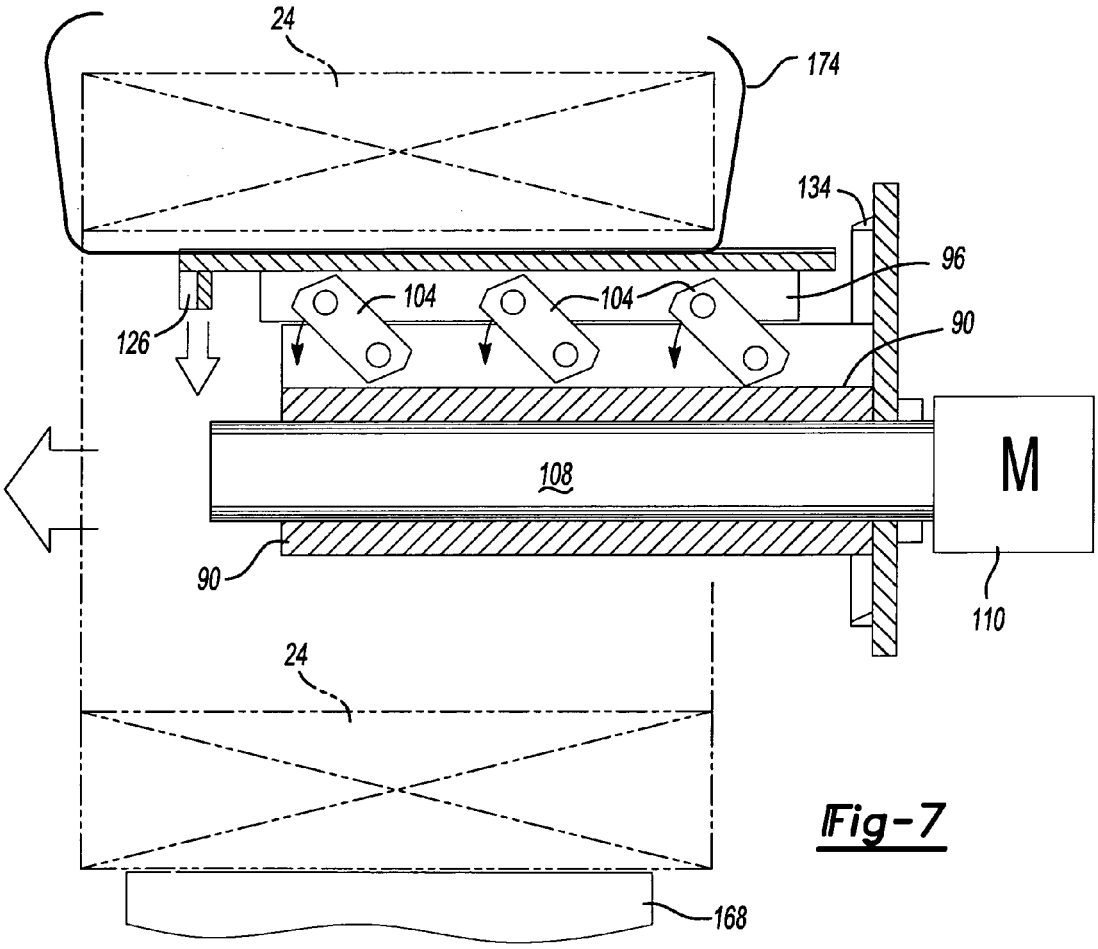
FIG. 7 is a view similar to FIG. 6 showing the winding wheel in another stage of operation.

As can be appreciated from FIG. 5, the links 104 are at an oblique angle relative to the axis 106 of the shaft 108. The force of gravity on the wound wire 24 draws the outer member 96 downward toward the central member 90. The inclination of the links 104 allows for gravity to cause movement of the outer member 96 in this manner. At this point, the outside dimension of the central core 88 has been reduced compared to that when the wire 24 was wound about the winding wheel 72. At this point, the inside dimension of the wound wire 24 is greater than the outside dimension of the central core 88 and the wire 24 can be removed in an axial direction (i.e., horizontally and to the left in FIGS. 6 and 7) from the winding wheel 72.

In another example, the outer members 92, 94, 96 are biased inward by a spring (not illustrated), for example, such that all three move radially inward when the end member 84 is not in a position to urge them toward the position where they define the largest core dimension.

To facilitate axially removing the wound wire, the moveable portion of the frame 76 along with the end member 84 preferably is pivoted in the direction schematically shown in the drawings at 140. Once the end member 84 is radially clear of the wound wire 24 (FIGS. 3 and 7), it becomes possible to readily remove the wound wire 24 from the central core 88.

The illustrated example includes a coil mover 150 that is selectively moveable relative to the winding wheel 72 as schematically shown by the arrow 152. In the illustrated example, tracks 154 are provided for guiding the coil mover 150. In this example, wheels 156 ride along the tracks 154. This example includes a motor 158 for driving the wheels. A stop 159 acts as a limit switch activator to stop the motor 158 once the coil mover is positioned beneath the winding wheel 72.

As best appreciated from FIG. 5, an example coil support 150 includes a base portion 160 and a support portion 162. A moving mechanism 164 and an actuator 166 facilitate moving the support 162 in a vertical direction (according to the drawing). This facilitates moving the support 162 into a position to engage the bottom of the wound wire 24. This prevents the wire from dropping below a selected height. In one example, the support 162 lifts the wound wire slightly relative to the central core 88 so that it can be more readily removed from the winding wheel 72. Angled retaining surfaces 168 facilitate maintaining the wound wire 24 balanced and in place on the support 162.

In one example, the actuator 166 is a motor that rotates a threaded member 170 of the moving mechanism 164 to adjust the height of the support 162 relative to the base 160. In another example, the actuator 166 is a pressurized actuator that moves appropriate components to the moving mechanism 164 to adjust the position of the support 162. One pressurized actuator is pneumatic.

In one example, the coil mover 150 does not lift the coil vertically when removing it from the central core 88. Instead, the coil is simply slid away from the central core in an axial direction until it is clear of the winding station 34 so that the moveable frame portion 76 can be returned to the position shown in FIG. 2, where the end member 84 again can be moved into engagement with the outer members 92, 94, 96 to establish the greatest outside dimension of the central core 88. At this point, another batch of wound wire 24 may be established.

The illustrated embodiment includes a feature that facilitates banding the wound wire 24 using conventional bands 174. Each of the outer members 92, 94, 96 in this example includes a slot 176 along which at least a portion of a band 174 is received to facilitate having the band along the inside of the wound wire 24 when it is coiled as shown in FIG. 3, for example. The slots 176 are best seen in FIGS. 3 and 4. Securing the bands 174 about the wound wire 24 can be done while the end member 84 is still axially aligned with the rest of the winding wheel 72. The slots 176 facilitate inserting the band material of the bands 174 before or after winding the wire 24.

As can be appreciated, the disclosed example embodiment of this invention provides an efficient arrangement for drawing wire through a die, winding the wire and subsequently handling the wire in a manner that is superior to conventional arrangements. One advantage of the disclosed arrangement is that it combines all of these features into a single machine. Another advantage is the ability to readily handle wound wire and efficiently remove it from the winding station of the machine where it can then be transported by forklift or other equipment for storage, shipping, etc.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A wire drawing and winding machine, comprising:

a die sized to form a wire of a desired diameter;

a drawing wheel that pulls wire stock through the die, the drawing wheel maintaining wire under tension between the die and the drawing wheel;

a winding wheel that receives wire from the drawing wheel and has a core with an adjustable outside dimension corresponding to a position of at least one moveable section relative to a central member, the at least one moveable section being in a first position relative to the central member for winding a selected amount of wire around the core and the at least one moveable section moving relatively closer to the central member responsive to gravity for reducing the adjustable outside dimension and releasing the wound wire from the core; and a coil mover that is moveable relative to the winding wheel into a position to support the wound wire for removal of the wire from the winding wheel.

2. The machine of claim 1, including a track that guides the coil mover in an axial direction relative to the winding wheel.

3. The machine of claim 1, wherein the coil mover includes a moveable support that is moveable in a direction perpendicular to the axis of the winding wheel such that the support is selectively moved into a position to contact the wound wire.

4. The machine of claim 1, wherein the winding wheel core comprises a linkage that supports the at least one moveable section for movement relative to the central member.

5. The machine of claim 4, wherein the central member includes three arms, each associated with a respective at least one moveable section and including a plurality of link members coupling the arms with the respective at least one moveable section.

6. The machine of claim 4, wherein the winding wheel includes a first disk near one end of the central member and a second disk that is selectively moveable in an axial direction relative to the central member, the second disk including at least one locator that cooperates with a corresponding locator on the at least one moveable section such that axial movement of the second disk toward the first disk causes the at least one moveable section to move toward the first position.

7. The machine of claim 6, wherein the second disk maintains the at least one moveable section in the first position and a weight of the wound wire and gravity operate to move the at least one moveable section toward the central member responsive to axial movement of the second disk away from the first disk.

8. The machine of claim 6, including an automated mover for moving the second disk in the axial direction.

9. The machine of claim 6, including a frame supporting the second disk, the frame including a moveable section that moves the second disk in a generally arcuate motion away from the central member to facilitate axially displacing the wound wire from the winding wheel.

10. A wire drawing and winding machine, comprising:

a die sized to form a wire of a desired diameter;

a drawing wheel that pulls wire stock through the die, the drawing wheel maintaining wire under tension between the die and the drawing wheel;

a winding wheel that receives wire from the drawing wheel and has a core with an adjustable outside dimension for winding a selected amount of wire around the core and then releasing the wound wire from the core; and a coil mover that is moveable relative to the winding wheel into a position at least partially beneath the winding wheel to support the wound wire for removal of the wire from the winding wheel as the wound wire moves downward responsive to the adjustable outside dimension changing from a first dimension used for winding the wound wire to a second, smaller dimension as caused by gravity.

11. A wire drawing and winding machine, comprising:

a die sized to form a wire of a desired diameter;

a drawing wheel that pulls wire stock through the die, the drawing wheel maintaining wire under tension between the die and the drawing wheel;

a winding wheel that receives wire from the drawing wheel and has a core with an adjustable outside dimension for winding a selected amount of wire around the core and then releasing the wound wire from the core;

a coil mover that is moveable relative to the winding wheel into a position to receive the wound wire for removal of the wire from the winding wheel upon adjustment of the outside dimension of the winding wheel; and a track that guides the coil mover in an axial direction relative to the winding wheel, the coil mover having at least one wheel for rolling along the track and a motor for driving the wheel.

12. The machine of claim 11, including a stop associated with the track to activate a limit switch to stop the motor when the coil mover is in a desired position relative to the winding wheel.

13. A wire drawing and winding machine, comprising:

a die sized to form a wire of a desired diameter;

a drawing wheel that pulls wire stock through the die, the drawing wheel maintaining wire under tension between the die and the drawing wheel;

a winding wheel that receives wire from the drawing wheel and has a core with an adjustable outside dimension for winding a selected amount of wire around the core and then releasing the wound wire from the core wherein the winding wheel core comprises a central member, at least one moveable section and a linkage that supports the moveable section for movement between a first position adjacent the central member and a second position spaced from the central member wherein the winding wheel includes a first disk near one end of the central member and a second disk that is selectively moveable in an axial direction relative to the central member, the second disk including at least one locator that cooperates with a corresponding locator on the moveable section such that axial movement of the second disk toward the first disk causes the moveable section to move from the first position toward the second position; and a coil mover that is moveable relative to the winding wheel into a position to support the wound wire for removal of the wire from the winding wheel.

14. The machine of claim 13, wherein the second disk maintains the moveable section in the second position and a weight of the wound wire and gravity operate to move the moveable section toward the first position responsive to axial movement of the second disk away from the first disk.

15. The machine of claim 13, including an automated mover for moving the second disk in the axial direction.

16. The machine of claim 13, including a frame supporting the second disk, the frame including a moveable section that moves the second disk in a generally arcuate motion away from the central member to facilitate axially displacing the wound wire from the winding wheel.

* * * * *